US009340028B2

(12) United States Patent
Hassaka et al.

(10) Patent No.: US 9,340,028 B2
(45) Date of Patent: May 17, 2016

(54) LIQUID STORING DEVICE, LIQUID STORING METHOD AND INKJET RECORDING DEVICE

(71) Applicant: SCREEN HOLDINGS CO., LTD., Kyoto (JP)

(72) Inventors: Ichiro Hassaka, Kyoto (JP); Ryuhei Sumida, Kyoto (JP); Satoshi Yasuda, Kyoto (JP); Tetsuya Ishida, Kyoto (JP); Kazuma Tani, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 14/602,383

(22) Filed: Jan. 22, 2015

(65) Prior Publication Data

US 2015/0210080 A1 Jul. 30, 2015

(30) Foreign Application Priority Data

Jan. 24, 2014 (JP) ..... 2014-010875

(51) Int. Cl.
*B41J 2/175* (2006.01)

(52) U.S. Cl.
CPC ..... *B41J 2/175* (2013.01); *B41J 2/17513* (2013.01)

(58) Field of Classification Search
CPC ..... B41J 2/17596; B41J 2/17509; B41J 2/17513; B41J 2/18; B41J 2/17566; B41J 2/17523; B41J 2/1752; B41J 2/17506
USPC ..... 347/84–86
See application file for complete search history.

(56) References Cited

U.S. PATENT DOCUMENTS 6,174,052 B1 * 1/2001 Eremity ..... B41J 2/16532 347/29
7,931,359 B2 * 4/2011 Esdaile-Watts ..... B41J 2/175 347/84
8,336,999 B2 * 12/2012 Matsumoto ..... B41J 2/17509 347/85

FOREIGN PATENT DOCUMENTS

JP 2010-022953 A 2/2010
JP 2010-022956 A 2/2010

* cited by examiner

*Primary Examiner* — An Do
(74) *Attorney, Agent, or Firm* — McDermott Will & Emery LLP

(57) ABSTRACT

The present invention provides a liquid storing device that includes at least a tank for storing a liquid, a supply tube that supplies the liquid to the tank, and a discharge tube that discharges the liquid stored in the tank. The supply tube diverges at a T branch joint into an upper supply tube and a lower supply tube. The upper supply tube has an upper supply port in the tank, the upper supply port positioned above a level of the liquid stored in the tank. The lower supply tube has a lower supply port in the tank, the lower supply port positioned below the level of the liquid.

7 Claims, 8 Drawing Sheets

LIQUID STORING DEVICE, LIQUID STORING METHOD AND INKJET RECORDING DEVICE

BACKGROUND OF THE INVENTION (1) Field of the Invention

The present invention relates to a liquid storing device for storing a liquid such as ink used in, for example, an inkjet recording device or the like, a liquid storing method, and an inkjet recording device.

(2) Description of Related Art

As a simple and inexpensive means of recording images, image recording devices that use inkjet printing are known (hereinafter referred to as "inkjet recording device"). Inkjet recording devices record a desired image by ejecting droplets of ink from nozzles on a printhead onto a recording medium. The trend with such an inkjet recording device in recent years is to increase the size of the ink tank, so as to enable mass printing and continuous printing and to avoid the trouble of having to replace ink cartridges or the like. Another approach is to provide two main ink tanks as an ink tank and use them alternately so that printing is not interrupted midway.

However, the increase in volume of the ink tank has led to a problem that a larger amount of ink is left over. That is, since a large-volume ink tank has a large cross-sectional area itself, a large amount of ink may still be left over even though a liquid surface detection sensor detects a low level of stored ink. In order to detect the amount of remaining ink in the ink tank (main tank) correctly, an ink-counter tank (tank with an ink counter function), for example, has been employed, which is provided between the main tank and a supply tube that leads to the printhead, as a means of grasping how much ink is left inside the main tank more correctly. FIG. 1 is an explanatory diagram illustrating a schematic configuration of such an ink-counter tank. The ink-counter tank (tank with an ink counter function) here corresponds to the liquid storing device.

As shown in the drawing, the ink-counter tank 100 is connected to a supply pump via a supply tube 101. Ink stored in the main tank (not shown) is supplied by this supply pump through the supply tube 101. The ink-counter tank 100 is equipped with a liquid surface detection sensor (not shown) for detecting the amount of remaining ink from the level of the stored ink. A discharge tube 102 is provided at the bottom of the ink-counter tank 100 for allowing the ink to be supplied to an intermediate tank or the like. A leak sensor is also attached to the ink-counter tank 100 so that leakage of ink from the ink-counter tank 100 can be detected.

A supply port of the supply tube 101 to the ink-counter tank 100 is formed at the bottom of the ink-counter tank 100, i.e., located below the level of stored ink. This is because, if the supply port is provided in an upper part of the ink-counter tank 100, i.e., above the level of ink, the ink supplied may drop down and splash on the surface of the ink, which may cause an erroneous detection by the liquid surface detection sensor.

Sometimes, however, the amount of remaining ink grasped with the use of such an ink-counter tank 100 may still not be accurate enough. For example, air that starts to be supplied with the ink to the ink-counter tank 100 as the amount of ink left in the main tank is reduced may cause an erroneous detection by the liquid surface detection sensor. That is, when ink containing air or air bubbles is supplied from the supply tube 101, air bubbles are generated in the stored ink, since the supply port is provided below the level of the ink. Bubbles may also be formed on the ink surface, and the ink level may fluctuate. These may result in an erroneous detection by the liquid surface detection sensor.

To deal with this problem, a degassing structure for a liquid delivery tube disclosed in Japanese Unexamined Patent Publication 2010-22953 may be used, for example. The document discloses an invention relating to a degassing structure for a liquid delivery tube, wherein a main tube through which liquid flows is diverged upwards into a degassing tube by a midway branch joint for removing air bubbles from the liquid. The branch joint includes an supply port where an upstream-side main tube on the upstream side of the main tube is connected, an outlet port where a downstream-side main tube on the downstream side of the main tube is connected, and an upward-oriented degassing port where an upstream side of the degassing tube is connected. The outlet port is oriented diagonally downwards. By adopting such a structure, allegedly, when a liquid containing air bubbles flows from upstream, the air bubbles in the liquid float up by buoyancy and flow into the degassing tube through the degassing port that diverges upwards. Even when the liquid containing air bubbles flows out the degassing port of the branch joint (branch part) and flows into the outlet port, allegedly, the air bubbles in the liquid float up by buoyancy, move along the top surface of the downwardly diagonal outlet port, and flow into the degassing port. However, it is difficult to completely remove air bubbles from the liquid even with such a method, since the liquid containing air bubbles can still flow out into the main tube.

Another possibility is to use a degassing method for a liquid delivery tube disclosed in Japanese Unexamined Patent Publication 2010-22956, for example. According to this invention, there are provided an inlet-side main tube connected to the supply port of a branch joint, an outlet-side main tube connected to the outlet, an upward-oriented degassing tube connected to a diverging end, a first flow passage open/close unit provided in a part of the degassing tube, and an air bubble sensor located to face the inlet-side main tube. When the air bubble sensor detects air bubbles, the first flow passage opening/closing unit is opened before the bubbles reach the outlet-side main tube, so that the liquid containing air bubbles flowing from the inlet-side main tube toward the outlet-side main tube flows into the degassing tube. However, it is difficult to completely remove air bubbles from the liquid even with such a method, since the liquid containing air bubbles can still flow out into the main tube.

BRIEF SUMMARY OF THE INVENTION

The present invention was made in view of the problems described above, its object being to provide a liquid storing device capable of reducing bubble formation and liquid level fluctuations in a tank even when a liquid containing gas or air bubbles is supplied to the tank, a liquid storing method, and an inkjet recording device.

The inventors of the present application have conducted research of the liquid storing device, liquid storing method, and inkjet recording device with a view to solve the problems mentioned above, found out that the problems can be resolved by adopting the configurations described below, and thereby completed the present invention.

In order to solve the above-mentioned problems, the liquid storing device according to the present invention comprises at least a tank for storing a liquid, a supply tube that supplies the liquid to the tank, and a discharge tube that discharges the liquid stored in the tank, the supply tube diverging at a branch part into an upper supply tube and a lower supply tube, the upper supply tube having an upper supply port in the tank, the upper supply port positioned above a level of the liquid stored in the tank, and the lower supply tube having a lower supply port in the tank, the lower supply port positioned below the level of the liquid.

According to the configuration described above, the supply tube that supplies liquid to the tank diverges at a branch part into an upper supply tube and a lower supply tube. The upper supply tube is connected in fluid communication with the tank, and has an upper supply port positioned above a level of the liquid stored in the tank. The lower supply tube is also connected in fluid communication with the tank, and has a lower supply port positioned below the level of the liquid. In this configuration, at least the lower supply tube is filled with the liquid when there is liquid stored in the tank. Therefore, when a liquid containing air or air bubbles flows through the supply tube, the air and the like can be made to flow into the upper supply tube and not into the lower supply tube because of the pressure being balanced between the liquid in the tank and the liquid in the lower supply tube. Namely, air or the like is prevented from being supplied from the lower supply port, so that formation of air bubbles in the liquid stored in the tank, or formation of bubbles on the liquid surface caused by such air bubbles, can be prevented. Liquid level fluctuations are reduced, too. As a result, an erroneous detection of the liquid level by a liquid level sensing device can be prevented.

In the above-mentioned device, it is preferable that the branch part is positioned above the level of the liquid stored in the tank. With the branch part located above the level of the liquid stored in the tank, the lower supply tube is filled with the liquid up to substantially the same level as that of the liquid in the tank. Therefore, when a liquid containing air or air bubbles flows through the supply tube, the air and the like can be made to flow into the tank only from the upper supply tube because of the pressure being balanced between the liquid in the tank and the liquid in the lower supply tube. Accordingly, entrance of air into the tank through the lower supply tube is prevented, so that formation of bubbles on the surface of the liquid in the tank is prevented more reliably. These both prevent an erroneous detection of the liquid level by the liquid level sensing device.

In the above-mentioned device, it is preferable that the branch part is positioned above a top surface of the tank.

In the above-mentioned device, it is preferable that the branch part is a branch joint formed by a main tube and a branch tube.

In the above-mentioned device, it is preferable that the branch part is a T branch joint having the branch tube diverging from the main tube substantially orthogonally, and the main tube is connected in fluid communication with the supply tube on an upstream side thereof, and is connected in fluid communication with the lower supply tube on a downstream side thereof, and the branch tube is connected in fluid communication with the upper supply tube. When the liquid flows at a constant flow rate through the branch part that is a T branch joint, the liquid mainly flows through the main tube and hardly flows through the branch tube. Since the main tube that is in fluid communication with the supply tube on the upstream side is connected in fluid communication with the lower supply tube on the downstream side in the configuration described above, the liquid that has flowed through the supply tube mainly flows into the lower supply tube. Thus the amount of liquid supplied from the upper supply tube is reduced, so that liquid level fluctuations and bubble formation that may be caused by splashing liquid when the liquid is supplied from the upper supply tube can be prevented.

In order to solve the above-mentioned problems, the liquid storing method according to the present invention comprises at least a tank for storing a liquid, a supply tube that supplies the liquid to the tank, and a discharge tube that discharges the liquid stored in the tank, wherein the supply tube diverges at a branch part into an upper supply tube and a lower supply tube, the upper supply tube having an upper supply port in the tank, the upper supply port positioned above a level of the liquid stored in the tank, and the lower supply tube having a lower supply port in the tank, the lower supply port positioned below the level of the liquid, the method comprising the steps of: supplying the liquid from the lower supply port of the lower supply tube into the tank when the liquid alone flows through the supply tube; and supplying air only from the upper supply port of the upper supply tube into the tank when air flows through the supply tube.

According to the configuration described above, when liquid alone flows through the supply tube, the liquid hardly enters the tank from the upper supply tube, so that the liquid is prevented from dropping and splashing on the surface of the liquid already stored in the tank. As a result, an erroneous detection that may be caused by bubbles formed on the liquid surface or liquid level fluctuations by the liquid level sensing device can be prevented. When air flows through the supply tube, it does not enter the tank from the lower supply tube, so that formation of air bubbles in the liquid stored in the tank is prevented. Since bubble formation and liquid level fluctuations that may result from such air bubbles are prevented, an erroneous detection by the liquid level sensing device caused by these can also be prevented.

In order to solve the above-mentioned problems, the inkjet recording device according to the present invention comprises a liquid storing device, the liquid storing device including at least a tank for storing a liquid, a supply tube that supplies the liquid to the tank, and a discharge tube that discharges the liquid stored in the tank, the supply tube diverging at a branch part into an upper supply tube and a lower supply tube, the upper supply tube having an upper supply port in the tank, the upper supply port positioned above a level of the liquid stored in the tank, and the lower supply tube having a lower supply port in the tank, the lower supply port positioned below the level of the liquid. If the liquid storing device is used as an ink-counter tank, for example, an inkjet recording device with a minimum amount of liquid to be left over in the main tank and capable of efficiently consuming the liquid can be provided, since erroneous detection of the remaining amount of liquid is prevented.

With the features described above, the present invention provides the following advantageous effects.

According to the present invention, the supply tube for supplying liquid to the tank is diverged into an upper supply tube and a lower supply tube. The upper supply tube supplies the liquid from above the level of the liquid stored in the tank, while the lower supply tube supplies the liquid from below the liquid level. Thereby, when air flows through the supply tube, the air can be made to flow through the upper supply tube and not the lower supply tube. As a result, bubbles are less likely to form in the liquid in the tank, and an erroneous detection that may be caused by bubbles present on the liquid surface or liquid level fluctuations by the liquid level sensing device can be prevented.

DETAILED DESCRIPTION OF THE INVENTION (Liquid Storing Device)

Figure 1:
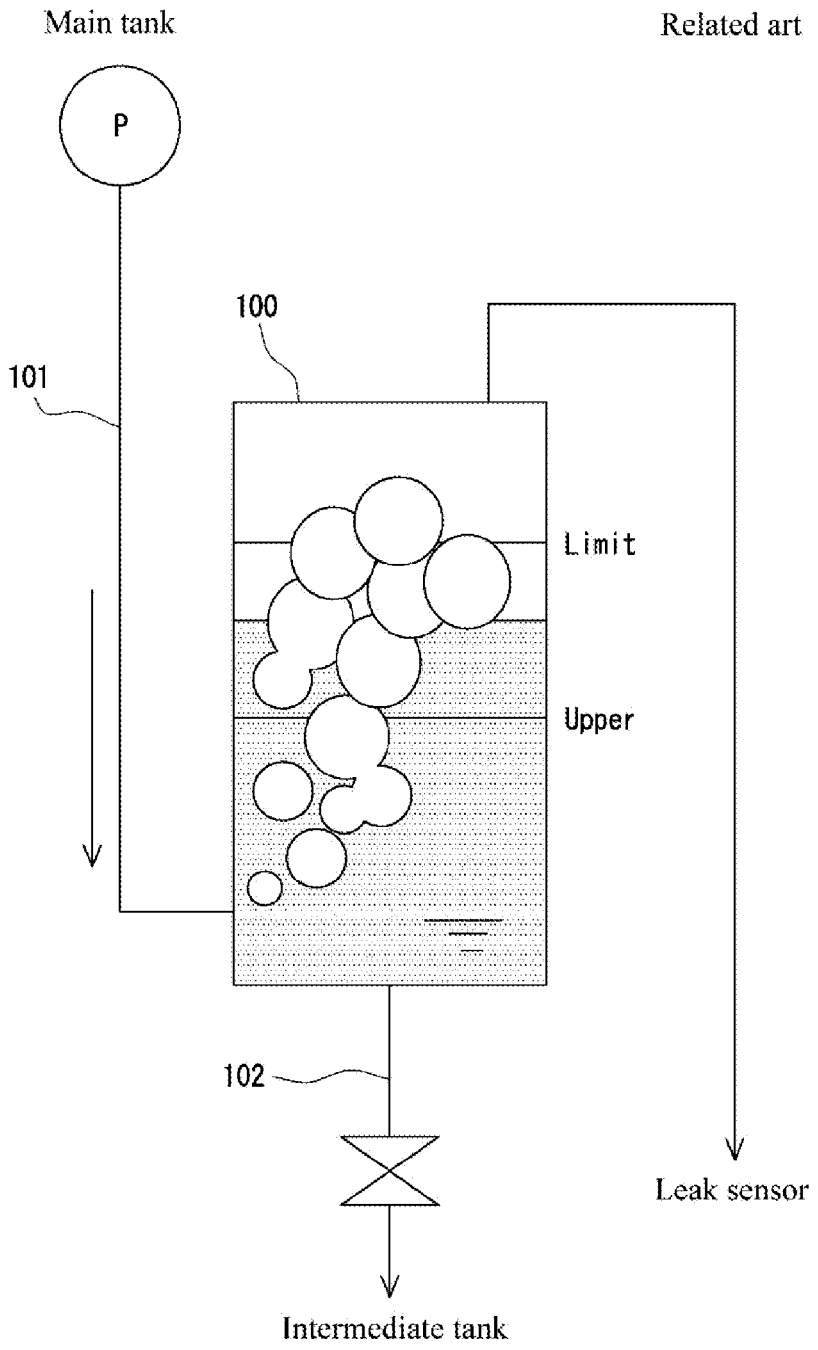
FIG. 1 is an explanatory diagram of the schematic of a liquid storing device in related art.

A liquid storing device according to one embodiment will be described below with reference to FIG. 2. FIG. 1 is an explanatory diagram of the schematic of the liquid storing device according to the embodiment.

Figure 2:
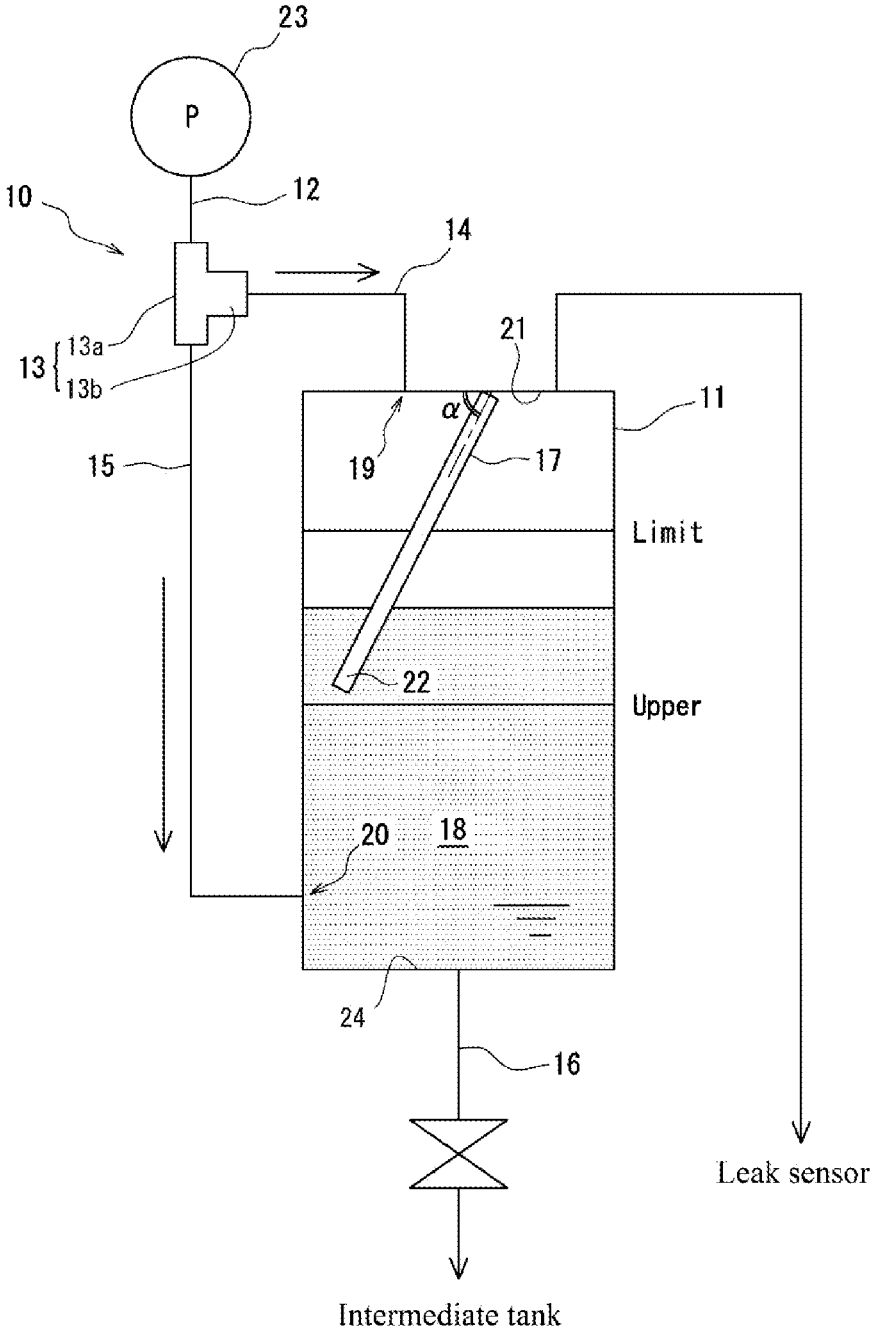
FIG. 2 is an explanatory diagram of the schematic of a liquid storing device according to one embodiment of the present invention.

As shown in FIG. 2, a liquid storing device 10 of this embodiment includes at least a tank 11 for storing a liquid 18, a supply tube 12 that supplies the liquid 18 to the tank 11, and a discharge tube 16 that discharges the liquid 18 stored in the tank 11. In this embodiment, as one option, a liquid level sensor (liquid level sensing device) that detects a remaining amount of liquid in the tank 11 is provided.

The tank 11 may be of any type as long as it can store a liquid 18 such as ink inside. Preferably, though, the tank 11 does not have a flexibility that allows it to expand or shrink in accordance with the volume of the stored liquid 18. This is because, as will be described later, deformation of the tank 11 may change the positional relationship in height between the level of the liquid 18 in the tank 11 and a T branch joint 13, even if the T branch joint 13 is positioned higher than the liquid level.

The liquid 18 is not limited to a particular one. The liquid 18 may be ink, for example, if the liquid storing device according to this embodiment is to be applied to an inkjet recording device.

The supply tube 12 is a circular tube and in fluid communication with a supply pump 23 for supplying the liquid 18. The supply tube 12 diverges at a T branch joint (branch part) 13 into an upper supply tube 14 and a lower supply tube 15. The upper supply tube 14 and lower supply tube 15 are both a circular tube and each in fluid communication with the tank 11. Although the supply tube 12, upper supply tube 14, and lower supply tube 15 are a circular tube in this embodiment, the present disclosure is not limited to this.

The upper supply tube 14 has an upper supply port 19 in a top surface 21 of the tank 11 so that the upper supply port 19 is located above the level of the liquid 18 (see FIG. 2). This arrangement reduces the possibility of air bubbles being formed in the liquid 18 or on the liquid surface when air flows from the upper supply tube 14, and prevents an erroneous detection of a liquid level by the liquid level sensor. The present disclosure does not limit the position of the upper supply port 19 which is provided in the top surface 21. The upper supply port 19 may only need to be positioned at least above the level of the liquid 18 stored in the tank 11. For example, if the level of the liquid 18 that varies in accordance with the stored amount can be controlled to not exceed a certain height position, then the upper supply port 19 may be provided in a side wall of the tank 11 above an expected maximum liquid level.

The lower supply tube 15 has a lower supply port 20 in a side wall surface near the bottom surface 24 of the tank 11 so that the lower supply port 20 is located below the level of the liquid 18 (see FIG. 2). This arrangement reduces the possibility of bubble formation and liquid level fluctuation, because, when the liquid is supplied from the lower supply tube 15, the liquid does not drop directly onto the surface of the liquid 18 in the tank 11, so that an erroneous detection of a liquid level by the liquid level sensor is prevented. The present disclosure does not limit the position of the lower supply port 20 to the one described above. The lower supply port 20 may only need to be positioned at least below the level of the liquid 18 stored in the tank 11. For example, the lower supply port 20 may be provided in the bottom surface 24 of the tank 11.

The T branch joint 13 is formed by a main tube 13*a* in which liquid flows straight, and a branch tube 13*b* that diverges from the main tube 13*a* substantially orthogonally. The main tube 13*a* communicates with the supply tube 12 on the upstream side, and with the lower supply tube 15 on the downstream side. The branch tube 13*b* communicates with the upper supply tube 14. Since the supply tube 12 and lower supply tube 15 are connected in fluid communication with each other via the main tube 13*a*, when only liquid 18 is supplied from the supply pump 23, the liquid 18 hardly diverges to the upper supply tube 14, and can readily flow into the lower supply tube 15. The inner diameters of the main tube 13*a* and branch tube 13*b* may be set appropriately in accordance with the inner diameters of the supply tube 12, upper supply tube 14, and lower supply tube 15.

The upper supply tube 14 and lower supply tube 15 may have different inner diameters, but the upper supply tube 14 and lower supply tube 15 preferably have substantially the same inner diameter. If the inner diameter of the upper supply tube 14 is larger than that of the lower supply tube 15, part of the liquid flowing through the supply tube 12 may more readily diverge into the upper supply tube 14 at an early stage of liquid supply, and may be supplied from the upper supply port 19 into the tank 11. This may cause bubbles to be formed on the surface of the liquid in the tank 11, or cause liquid level fluctuations. If the inner diameter of the lower supply tube 15 is larger than that of the upper supply tube 14, air may enter from the lower supply tube 15 at an early stage of liquid supply. This may cause air bubbles to be generated in the liquid 18 in the tank 11, and may result in bubble formation on the surface of the liquid, too. The inner diameter of the supply tube 12 may be the same as or different from the inner diameter of the upper supply tube 14 (or lower supply tube 15). The upper supply port 19 in the tank 11 of the upper supply tube 14 may have a diameter that is either the same as or different from the inner diameter of the upper supply tube 14. The lower supply port 20 in the tank 11 of the lower supply tube 15 may have a diameter that is either the same as or different from the inner diameter of the lower supply tube 15.

Figure 6:
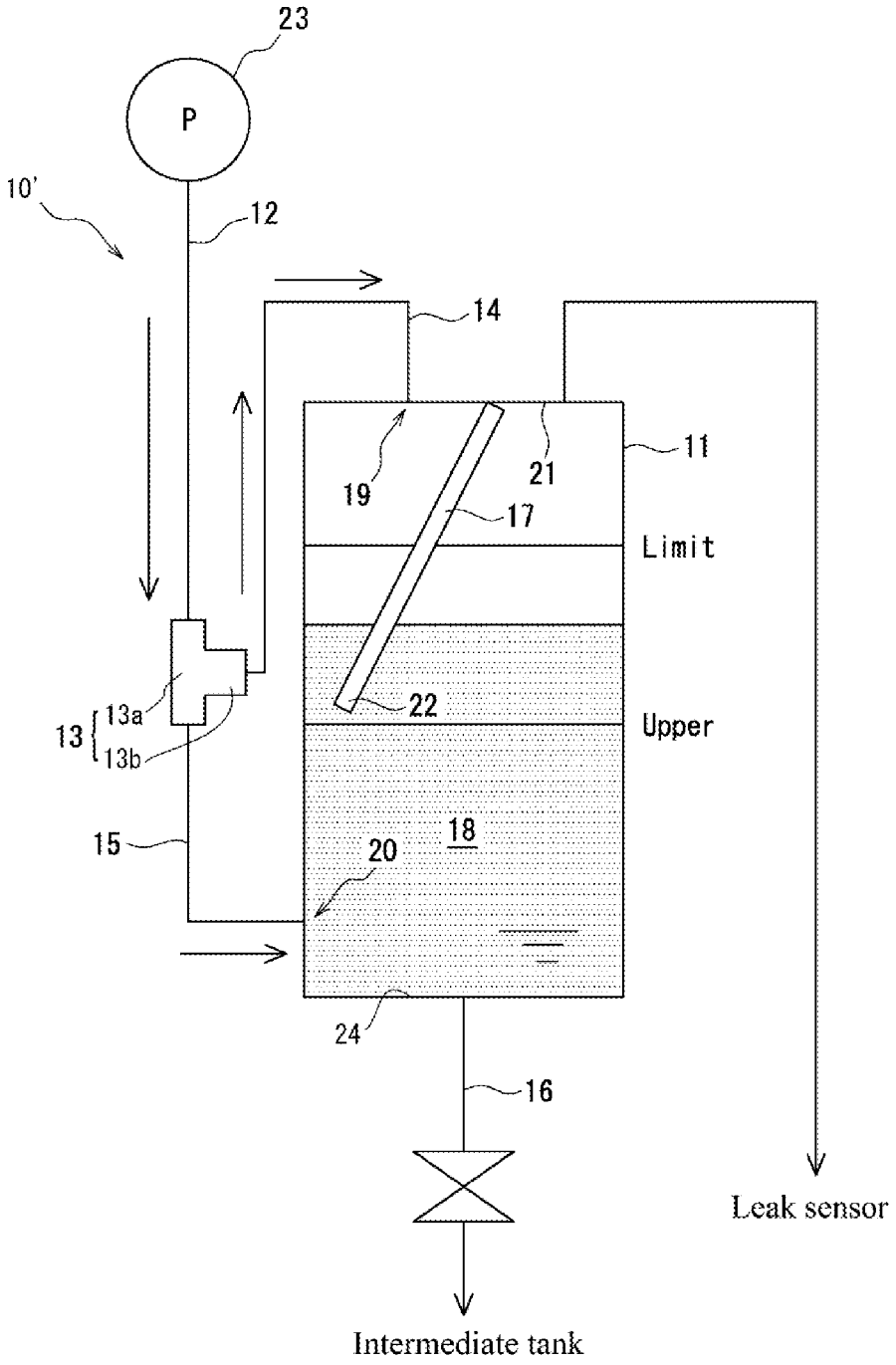
FIG. 6 is an explanatory diagram of the schematic of a liquid storing device according to another embodiment of the present invention.

The T branch joint 13 is preferably positioned above the level of the liquid 18 stored in the tank 11. The level of the liquid 18 varies up and down in accordance with the varying amount of the liquid 18 in the tank 11. Therefore, the position of the T branch joint 13 in the up and down direction is preferably set in consideration of the variation range of the level of the liquid 18 in the tank 11. If the tank 11 is to be completely filled with the liquid 18, the T branch joint 13 is preferably provided at a position higher than the top surface 21 of the tank 11. The present disclosure does not limit the height position of the T branch joint 13 to above the level of the liquid 18 stored in the tank 11. For example, even if the T branch joint 13 may be provided below the level of the liquid 18 as shown in FIG. 6, liquid level fluctuations and bubble formation can be reduced, and occurrence of erroneous detection by the liquid level sensor can be reduced (as will be described in more detail later).

The discharge tube 16 is connected to a bottom part of the tank 11 for discharging the liquid 18 stored in the tank 11 to supply the liquid to an intermediate tank or the like. The discharge tube 16 may have an inner diameter that is not particularly limited and may be appropriately set.

In this embodiment, as shown in FIG. 2, it is preferable to provide a partition plate 17 on the top surface 21 of the tank 11. With the partition plate 17, in the case of bubbles being formed on the surface of the liquid 18 stored in the tank 11 by the liquid 18 dropping from the upper supply port 19, such bubbles can be prevented from spreading to the entire liquid surface. The partition plate 17 is preferably inclined at an arbitrary angle $\alpha$ ($\alpha<90°$) relative to the top surface 21 and positioned at least partly on a line along a vertical direction of the upper supply port 19 of the upper supply tube 14. Thereby, the liquid 18 supplied from the upper supply tube 14 can drop onto the partition plate 17 and not onto the surface of the liquid 18. As a result, liquid level fluctuations and bubble formation are reduced, and an erroneous detection by the liquid level sensor can be prevented. The angle $\alpha$ may be appropriately set in accordance with the space inside the tank, the size of the partition plate 17, and the like. The size (area) or width of the partition plate 17 may be appropriately set in accordance with the volume of the inside of the tank 11. Although the length of the partition plate 17 is not particularly limited, it may have a length long enough for a distal end 22 to be immersed in the liquid 18, as shown in FIG. 2. With the distal end 22 immersed, fine air bubbles that may be formed in the liquid 18 are prevented from spreading. Also, the liquid that has dropped onto the partition plate 17 runs down on the plate and can be prevented from dropping onto the liquid surface. There may be a plurality of partition plates 17, to prevent spreading of air bubbles more reliably.

The liquid level sensor (liquid level sensing device) is capable of detecting a level of the liquid 18 to detect the amount of liquid 18 stored in the tank 11. More specifically, the liquid level sensor is provided at a position labeled "Upper" in FIG. 2, for example, to determine whether or not there is a sufficient amount of liquid 18 in the tank 11. It is then determined whether or not the liquid 18 stored in the tank 11 can be discharged to the intermediate tank. In this embodiment, entrance of air from the lower supply port 20 is prevented, to prevent formation of air bubbles in the tank 11. Therefore, the liquid level sensor at the position labeled "Upper" in FIG. 2 can be prevented from erroneously detecting the liquid 18 when there is actually no liquid there. The liquid level sensor is provided at a position labeled "Limit" in FIG. 2, for example, to detect an upper limit of the liquid 18 stored in the tank 11. Liquid supply from a main tank by the supply pump 23 may be stopped if the liquid level sensor detects the liquid level. As a result, entrance of the liquid 18 into the discharge tube or the like due to an excessive supply into the tank 11 can be prevented. In this embodiment, bubble formation on the surface of the liquid 18 or liquid level fluctuations in the tank 11 are prevented. Therefore, the liquid level sensor at the position labeled "Limit" in FIG. 2 can be prevented from erroneously detecting the liquid 18 when the liquid 18 is actually not contained up to the upper limit, which may cause the supply of the liquid 18 from the main tank to stop. The liquid level sensor is not limited to a particular type and any of known sensors may be employed. More specifically, for example, a float-type liquid level sensor, an ultrasonic-type liquid level sensor, or an electro-optic-type liquid level sensor, and the like may be used. If an electro-optic-type liquid level sensor is to be used, the tank 11 preferably has light transmissivity. The liquid storing device 10 of this embodiment may include a leak sensor, as shown in FIG. 2. This will allow detection of leakage of the liquid 18 from the tank 11.

(Liquid Storing Method)

Figure 3:
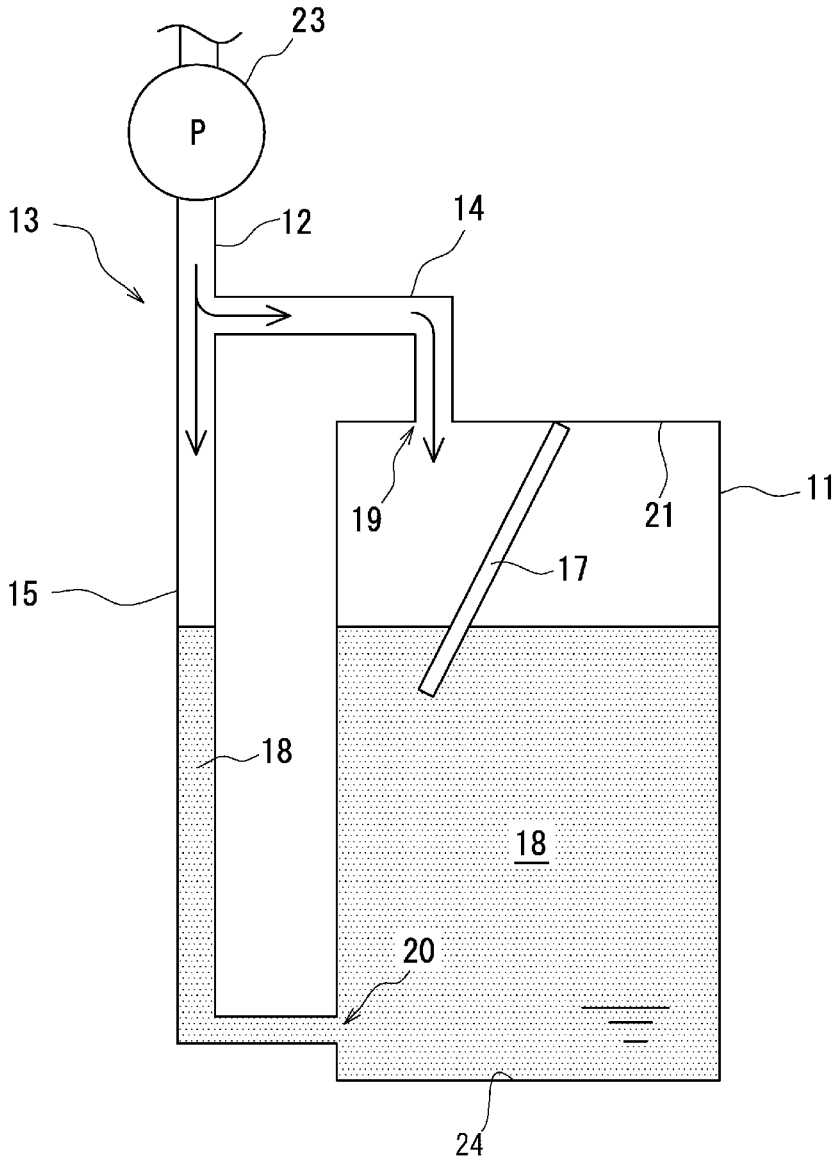
FIG. 3 is a conceptual diagram schematically showing air flows in the liquid storing device.
Figure 4:
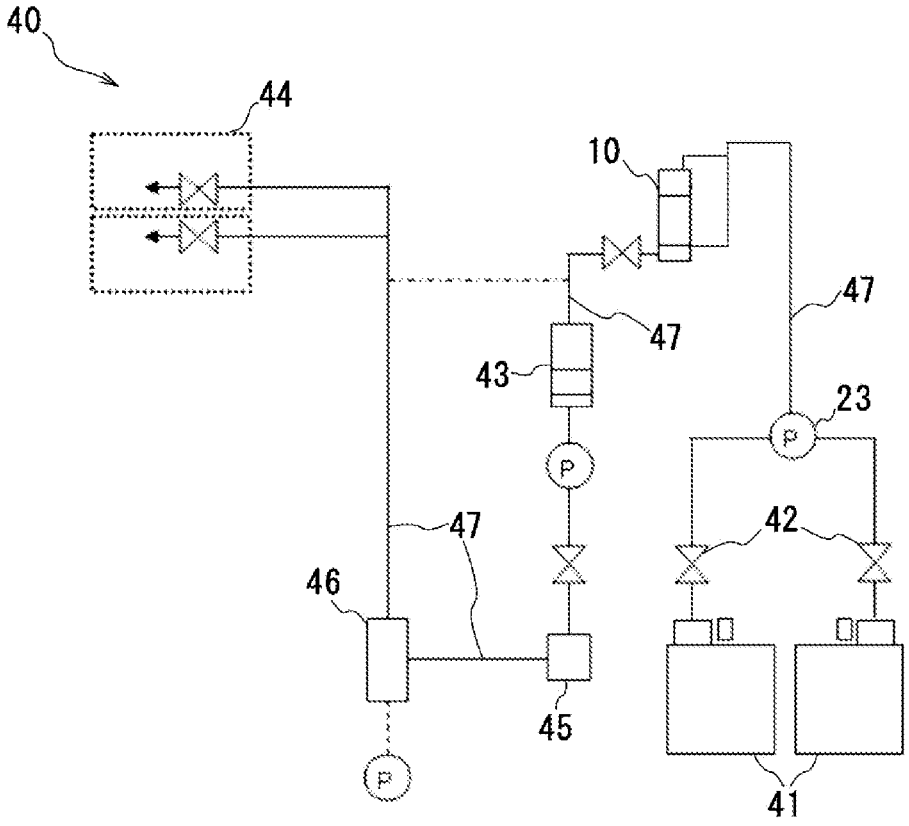
FIG. 4 is a schematic configuration diagram of an inkjet recording device having the liquid storing device.

Next, a liquid storing method that uses the liquid storing device 10 will be described below. FIG. 3 is a conceptual diagram schematically showing air flows in the liquid storing device.

First, there is the liquid 18 stored in a main tank (not shown), and the supply pump 23 supplies the liquid 18 by drawing it out of the main tank. When the main tank is sufficiently filled with the liquid 18, only the liquid 18 is supplied. The liquid 18 flows through the supply tube 12 via the T branch joint 13 more into the lower supply tube 15 than into the upper supply tube 14. The liquid 18 flows into the lower supply tube 15 more easily because the supply tube 12 and the lower supply tube 15 are connected in fluid communication with the main tube 13*a* of the T branch joint 13 so that the fluid 18 flows at a constant flow rate. On the other hand, the upper supply tube 14 is connected in fluid communication with the branch tube 13*b* that diverges from the main tube 13*a* of the T branch joint 13 substantially orthogonally, so that the fluid 18 hardly diverges. The fluid 18 flowing through the lower supply tube 15 enters the tank 11 from the lower supply port 20. When the liquid 18 only is supplied from the supply pump 23, supply of the liquid 18 into the tank 11 from the upper supply port 19 is prevented as much as possible, so that liquid level fluctuations or bubble formation are reduced, and an erroneous detection by the liquid level sensor resulting therefrom can be prevented.

On the other hand, when air (or liquid containing air bubbles) is supplied by the supply pump 23 because the remaining amount of the liquid 18 in the main tank is small or because of other reasons, this air flows through the supply tube 12 and into the upper supply tube 14 via the T branch joint 13. This is because the T branch joint 13 is positioned above the level of the liquid 18 in the tank 11. Namely, since the T branch joint 13 is positioned above the level of the liquid 18 in the tank 11, the lower supply tube 15 is filled with the liquid 18 up to the same position as that of the liquid in the tank 11. On the other hand, there is no liquid 18 in the upper supply tube 14. Therefore, the air cannot flow into the lower supply tube 15 and flows only into the upper supply tube 14 because of the pressure being balanced between the liquid 18 in the tank 11 and the liquid 18 in the lower supply tube 15. As a result, air flows into the tank 11 only from the upper supply port 19, and is prevented from entering the tank 11 from the lower supply port 20. In this way, air bubbles are prevented from being formed by air blown into the liquid 18 stored in the tank 11, whereby an erroneous detection by the liquid level sensor is prevented.

As described above, with the liquid storing method that uses the liquid storing device 10, supply of liquid and air are controlled such that, when the liquid 18 alone is supplied, it is mostly supplied into the tank 11 from the lower supply tube 15, whereas, when air or the like is supplied, it is sent into the tank 11 only from the upper supply tube 14. As a result, generation of air bubbles in the liquid 18 in the tank 11, liquid level fluctuations, and bubble formation are reduced, and an erroneous detection by the liquid level sensor can be prevented.

(Inkjet Recording Device)

Next, an inkjet recording device that uses the liquid storing device 10 as an ink-counter tank will be described below. FIG.

4 is a schematic configuration diagram of an inkjet recording device having the liquid storing device.

The inkjet recording device 40 includes at least the liquid storing device 10, two main tanks 41, an intermediate tank 43, a filter 45, a degassing module 46, and a printhead 44.

The main tanks 41 store ink, i.e., they are the supply source of the ink. The main tanks 41 each have a solenoid valve 42 connected thereto and are configured such that when the ink in one main tank 41 is consumed, it is supplied from the other main tank 41. The liquid storing device 10 is connected in fluid communication with the main tanks 41 via a supply line 47 so that the ink stored in the main tanks 41 can be supplied by the supply pump 23.

The liquid storing device 10 has a function to act as an ink-counter tank and detects the amount of remaining ink stored in the main tanks 41. The intermediate tank 43 is connected in fluid communication with the liquid storing device 10 via the supply line 47 to temporarily store and supply the ink to the printhead 44.

The filter 45 is provided between the intermediate tank 43 and the degassing module 46 to remove dust or the like contained in the ink. The degassing module 46 is provided between the filter 45 and the printhead 44 to remove dissolved gasses such as oxygen from the ink. The degassing module 46 can prevent unstability in the state of ink propelled at the printhead 44.

By applying the liquid storing device 10 of this embodiment as an ink-counter tank, the remaining amount of ink in the main tanks 41 can be determined accurately. Accordingly, an inkjet recording device that can consume ink with a minimum amount of ink to be left over can be provided.

(Other Points)

While a T branch joint 13 is used as the branch part in this embodiment, the present disclosure is not limited to this, and the branch part may be any other branch joints that at least have a main tube and a branch tube. Examples of such branch joints include, for example, a Y branch joint 31 shown in FIG. 5A, and a Y branch joint 32 shown in FIG. 5B.

Figure 5A:
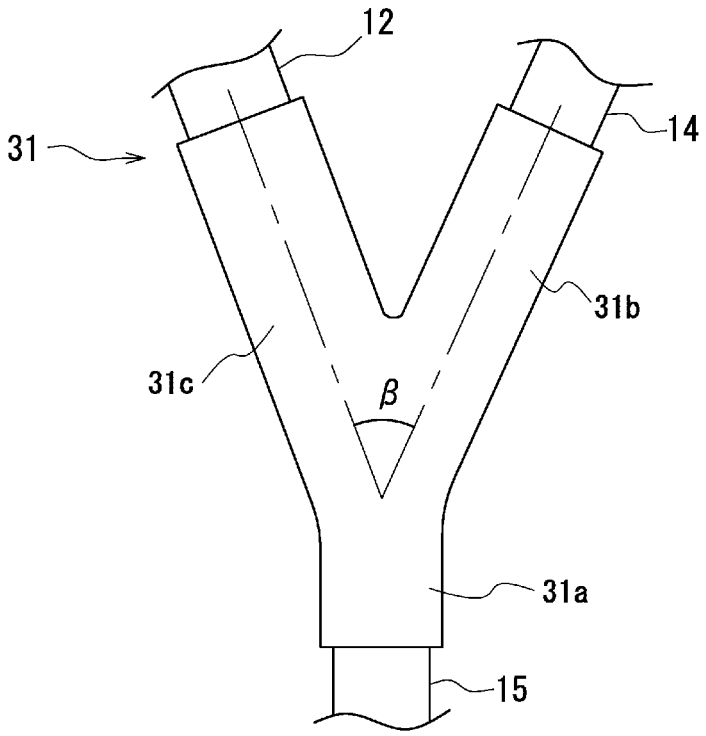
FIG. 5A and FIG. 5B are plan views showing other branch parts in the liquid storing device.

The Y branch joint 31 shown in FIG. 5A preferably has a main tube 31*a*, a first branch tube 31*b*, and a second branch tube 31*c* connected to the lower supply tube 15, the upper supply tube 14, and the supply tube 12 in fluid communication, respectively. Since the second branch tube 31*c* opens at an angle relative to the first branch tube 31*b* that is connected to the supply tube 12, the liquid 18 that flows from the supply tube 12 can hardly diverge into the upper supply tube 14 in the Y branch joint 31. The present disclosure is not limited to this. For example, the main tube 31*a*, the first branch tube 31*b*, and the second branch tube 31*c* may be connected to the supply tube 12, the supply tube 12, and the lower supply tube 15, respectively. The angle β between the first branch tube 31*b* and the second branch tube 31*c* (β<90°) is not particularly limited and may be appropriately set in accordance with the flow amount or the like of the liquid 18.

Figure 5B:
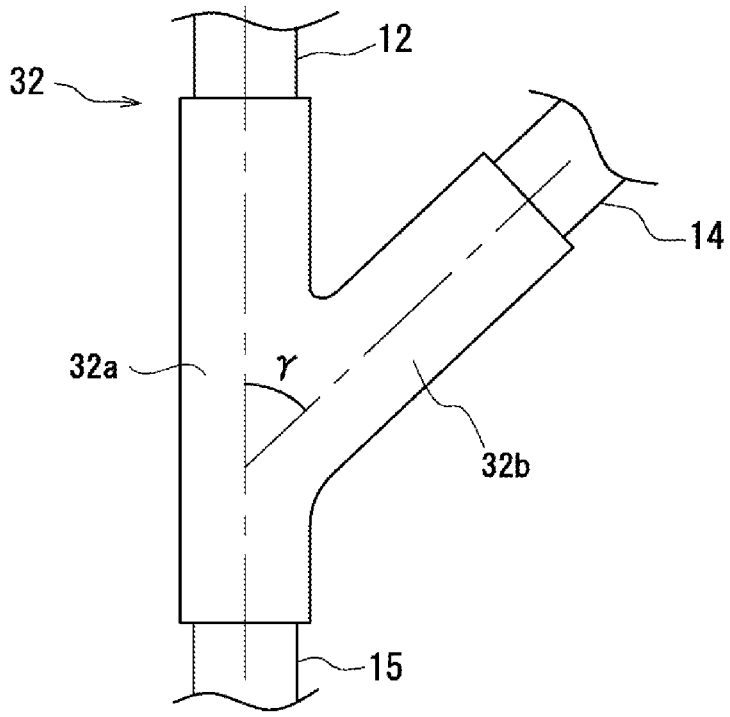

The Y branch joint 32 shown in FIG. 5B preferably has a main tube 32*a* connected to the supply tube 12 and the lower supply tube 15, and a branch tube 32*b* connected to the upper supply tube 14. The supply tube 12 is connected to the main tube 32*a* at one end toward which the branch tube 32*b* is inclined. The lower supply tube 15 is connected to the opposite end from the end toward which the branch tube 32*b* is inclined. Since the branch tube 32*b* opens at an angle inclined toward the supply tube 12 that is connected to the main tube 32*a*, the liquid 18 that flows from the supply tube 12 can hardly diverge into the upper supply tube 14 in the Y branch joint 32. Note, the supply tube 12 and the lower supply tube 15 may be connected to the main tube 32*a* invertedly from the form shown in FIG. 5B. Alternatively, the branch tube 32*b* may be connected to the supply tube 12, and the main tube 32*a* may be connected to the upper supply tube 14 on the upstream side and to the lower supply tube 15 on the downstream side. The angle γ between the main tube 32*a* and the branch tube 32*b* (γ<90°) is not particularly limited and may be appropriately set in accordance with the flow amount or the like of the liquid 18.

Figure 7:
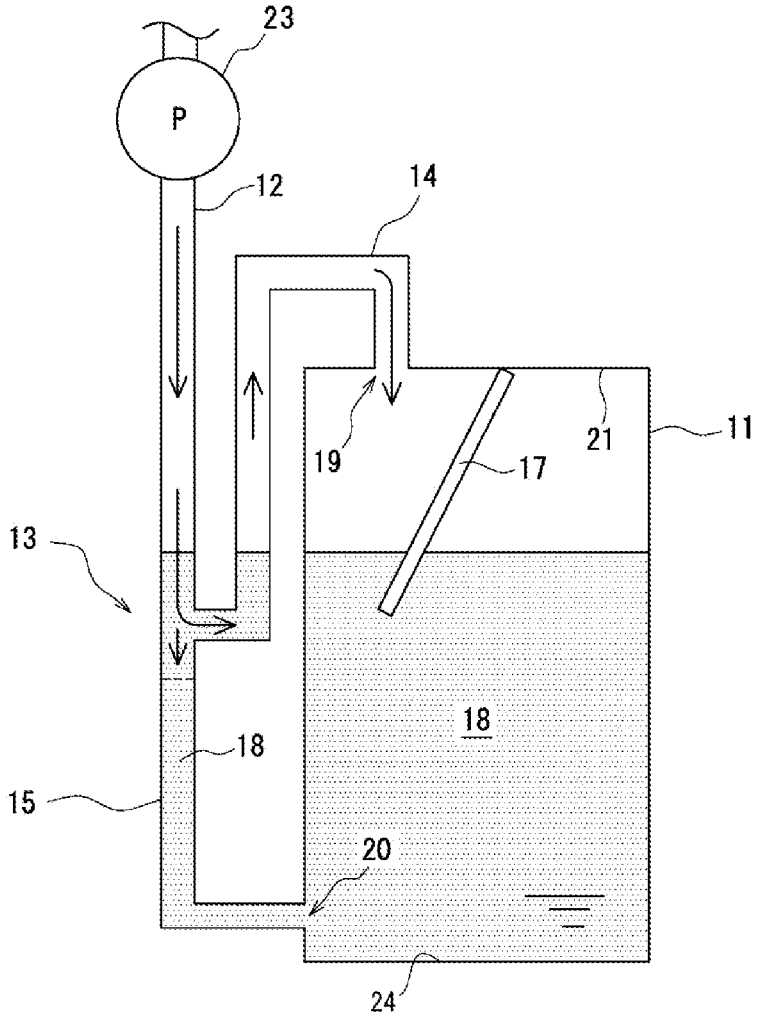
FIG. 7 is a conceptual diagram schematically showing air flows in the liquid storing device.

In this embodiment described above, the T branch joint 13 is positioned above the level of the liquid 18 in the tank 11. The present disclosure is not limited to this, and a liquid storing device 10' having a T branch joint 13 positioned below the level of the liquid 18 in the tank 11, for example, as shown in FIG. 6 and FIG. 7, can also reduce occurrence of erroneous detection by the liquid level sensor. FIG. 6 is an explanatory diagram of the schematic of a liquid storing device according to another embodiment of the present disclosure. FIG. 7 is a conceptual diagram schematically showing air flows in the liquid storing device.

Namely, if the T branch joint 13 is positioned below the level of the liquid 18 in the tank 11, the liquid 18 fills not only the lower supply tube 15 but reaches up in the supply tube 12 and part of the upper supply tube 14. In this state, when air is sent from the supply pump at an initial stage, the air presses down the liquid 18 that has been present in the supply tube 12 to a position indicated by a dotted line in the lower supply tube 15 that is located lower than the T branch joint 13. At the same time, the liquid 18 inside the upper supply tube 14 is all sent out into the tank 11. However, air sent out afterwards all flows through the upper supply tube 14 and into the tank 11 from the upper supply port 19 because of the pressure being balanced between the liquid 18 in the tank 11 and the liquid 18 in the lower supply tube 15. Accordingly, no air enters from the lower supply tube 15 so that formation of air bubbles in the tank 11 can be prevented. Since bubble formation on the liquid surface and liquid level fluctuations are reduced, an erroneous detection by the liquid level sensor can be prevented. Although the liquid 18 flows into the tank 11 from the upper supply tube 14 at the initial stage, the liquid to be supplied does not drop directly onto the surface of the liquid 18, because there is the partition plate 17 provided in the tank 11. Therefore, liquid level fluctuations and bubble formation are minimized even in the initial state.

What is claimed is:

1. A liquid storing device comprising at least a tank for storing a liquid, a supply tube that supplies the liquid to the tank, and a discharge tube that discharges the liquid stored in the tank, the supply tube diverging at a branch part into an upper supply tube and a lower supply tube, the branch part being formed by a main tube and a branch tube, and being also a T branch joint diverging in a direction substantially orthogonal to the main tube, the main tube being connected in fluid communication with the supply tube on an upstream side thereof, and being connected in fluid communication with the lower supply tube on a downstream side thereof, the branch tube being connected in fluid communication with the upper supply tube, the upper supply tube having an upper supply port in the tank, the upper supply port positioned above a level of the liquid stored in the tank, and the lower supply tube having a lower supply port in the tank, the lower supply port positioned below the level of the liquid.

2. The liquid storing device according to claim 1, wherein the branch part is positioned above the level of the liquid stored in the tank.

3. The liquid storing device according to claim 2, wherein the branch part is positioned above a top surface of the tank.

4. The liquid storing device according to claim 1, wherein the branch part is positioned below the level of the liquid stored in the tank.

5. The liquid storing device according to claim 1, wherein the upper supply tube and the lower supply tube have substantially the same inner diameter.

6. The liquid storing device according to claim 1, wherein the upper supply port of the upper supply tube and a partition plate are provided in a top surface of the tank, the partition plate being inclined at a given angle relative to the top surface, and the partition plate is at least partially located on a line along a vertical direction of the upper supply port of the upper supply tube, and has a distal end immersed in the liquid stored in the tank.

7. An inkjet recording device comprising a liquid storing device, the liquid storing device including at least a tank for storing a liquid, a supply tube that supplies the liquid to the tank, and a discharge tube that discharges the liquid stored in the tank, the supply tube diverging at a branch part into an upper supply tube and a lower supply tube, the branch part being formed by a main tube and a branch tube, and being also a T branch joint diverging in a direction substantially orthogonal to the main tube, the main tube being connected in fluid communication with the supply tube on an upstream side thereof, and being connected in fluid communication with the lower supply tube on a downstream side thereof, the branch tube being connected in fluid communication with the upper supply tube, the upper supply tube having an upper supply port in the tank, the upper supply port positioned above a level of the liquid stored in the tank, and the lower supply tube having a lower supply port in the tank, the lower supply port positioned below the level of the liquid.

* * * * *